US005284546A

United States Patent [19]

Tilby

[11] Patent Number: 5,284,546

[45] Date of Patent: Feb. 8, 1994

[54] APPARATUS FOR MANUFACTURE OF STRUCTURAL PANEL

[76] Inventor: Sydney E. Tilby, 4688 Boulderwood Drive, Victoria, B.C., Canada, V8Y 2P8

[21] Appl. No.: 637,346

[22] Filed: Jan. 4, 1991

[51] Int. Cl.[5] ..... B30B 5/04; B30B 15/34

[52] U.S. Cl. ..... 156/583.5; 100/93 RP; 100/152; 100/154; 156/62.2; 425/371; 264/128

[58] Field of Search ..... 156/62.2, 62.4, 296, 156/583.5; 264/128; 425/371; 100/93 RP, 154, 151, 152

[56] References Cited

U.S. PATENT DOCUMENTS

| | | | |
|---|---|---|---|
| 2,592,470 | 4/1952 | Ryberg | 154/1 |
| 2,648,262 | 8/1953 | Croston et al. | 92/61 |
| 2,717,420 | 9/1955 | Roy | 18/22 |
| 2,853,413 | 9/1958 | Christian | 154/132 |
| 2,909,804 | 10/1959 | Means | 425/107 |
| 3,164,511 | 1/1965 | Elmendorf | 161/57 |
| 3,437,508 | 4/1069 | Gorski | 264/128 |
| 3,464,877 | 9/1969 | Miller et al. | 156/259 |
| 3,464,881 | 9/1969 | Miller et al. | 161/60 |
| 3,567,511 | 3/1971 | Tilby | 127/43 |
| 3,690,358 | 9/1972 | Tilby | 146/119 |
| 3,795,470 | 3/1974 | De Mets | 100/151 |
| 3,929,065 | 12/1975 | Csordas | 100/154 |
| 4,025,278 | 5/1977 | Tilby | 425/404 |
| 4,061,819 | 12/1977 | Barnes | 156/62.2 |
| 4,186,797 | 2/1980 | Guttinger | 100/154 |
| 4,212,616 | 7/1980 | Tilby | 425/256 |
| 4,263,007 | 4/1981 | Battigelli et al. | 425/371 |
| 4,312,677 | 1/1982 | Tilby et al. | 127/2 |
| 4,334,468 | 6/1982 | Guttinger | 100/93 RP |
| 4,456,498 | 6/1984 | Churchland | 156/583.5 |
| 4,494,919 | 1/1985 | Knudson et al. | 425/83.1 |
| 4,517,148 | 5/1985 | Churchland | 156/583.5 |
| 4,580,960 | 4/1986 | Apman et al. | 156/62.2 |
| 4,751,131 | 6/1988 | Barnes | 156/62.2 |
| 4,940,502 | 7/1990 | Marcus | 156/296 |

FOREIGN PATENT DOCUMENTS

| | | | |
|---|---|---|---|
| 1084014 | 6/1960 | Fed. Rep. of Germany . | |
| 1384388 | 3/1988 | U.S.S.R. | 425/371 |

*Primary Examiner*—Michael W. Ball
*Assistant Examiner*—Daniel J. Stemmer
*Attorney, Agent, or Firm*—Jansson & Shupe

[57] ABSTRACT

A method and apparatus for making structural panel from the rinds of sugarcane and similar woody grasses. The method includes providing a collection of straight and rather long rind fiber-bundle strands, coating them with binder, depositing coated strands in a loose pile with the strands randomly oriented in substantially parallel planes, pressing the pile to a final thickness, and curing to interconnect each strand with others. The curing step preferably includes moving air through the pile, which had been deposited on a perforated belt and pressed between a pair of such belts.

7 Claims, 3 Drawing Sheets

APPARATUS FOR MANUFACTURE OF STRUCTURAL PANEL

FIELD OF THE INVENTION

This invention is related generally to building materials and, more particularly, to the manufacture of wall and ceiling panels made of natural plant fibers like the woody rinds of grasses such as sugarcane and sweet sorghum.

BACKGROUND OF THE INVENTION

Many kinds of board products have been made from woody plant fibers in the form of chips, slabs, strands, shreds, particles, sawdust, shavings, comminutions, and other fiber forms. Such fibrous materials have been bound together using a variety of binders and forming methods to produce boards or panels referred to as chipboard, particle board, fiberboard, strand board, wood-wool board, veneer board, and pressboard, to name just some.

It is known that the woody rinds of grasses such as sugarcane and sweet sorghum can be used in producing some of such boards. Additionally, it is known that such rinds, that is the fibers from such rinds, can be aligned and bonded to form boards having characteristics much like solid natural hardwood.

United States patents have been granted on various improvements relating to the above-noted manufactured panels and boards, including the following patents:

U.S. Pat. No. 2,592,470 (Ryberg)
U.S. Pat. No. 2,648,262 (Croston et al.)
U.S. Pat. No. 2,717,420 (Roy)
U.S. Pat. No. 2,853,413 (Christian)
U.S. Pat. No. 3,164,511 (Elmendorf)
U.S. Pat. No. 3,464,881 (Miller et al.)
U.S. Pat. No. 3,464,877 (Miller et al.)
U.S. Pat. No. 3,567,511 (Tilby)
U.S. Pat. No. 3,690,358 (Tilby)
U.S. Pat. No. 4,025,278 (Tilby)
U.S. Pat. No. 4,212,616 (Tilby)
U.S. Pat. No. 4,312,677 (Tilby et al.).

While some of these patents relate to the solid boards mentioned above, most relate to lighter and less expensive boards and panels. A long-standing problem or shortcoming of the latter boards and panels is their structural weakness. Because of this, few of them have excellent weight-bearing and structural characteristics; such boards and panels often serve lesser covering, underlying, or decorative needs. Many of such boards and panels have little ability to serve in situations exposing them to weather, because weakening can occur.

In many cases, the strength of such panels and boards is provided primarily by the binder rather than by the fibers used in manufacture. In some cases, a degree of strength is achieved by the degree of packing. In others, the use of large amounts of binder per unit volume of product increases the cost of such panels.

Such panels not only are lacking in structural strength, but typically do not have good insulating qualities. Because of this the usefulness of such panels is often quite limited.

Manufacture of such panels and boards has been carried out in various methods, some requiring complex extrusion equipment or other manufacturing equipment. The processes used in making such panels and boards often require extended periods to achieve drying throughout the cross-section of the board or panel, and significant amounts of energy.

A major problem in many developing countries and elsewhere is the shortage of high-quality building materials or, stated differently, the high cost of materials used for various building needs, including residential housing. In many cases, locally manufactured materials may not be available, requiring importation which adds to costs.

In summary, there is a clear need for an improved apparatus and method for manufacture of structural panels. Such apparatus must be low in cost and be able to produce low-cost, light-weight structural panels having good load-bearing qualities, good insulative qualities, and good weather-resistance An apparatus for production of structural panels from sugarcane and sorghum rinds, particularly in developing countries, would provide important advantages.

Objects of the Invention

It is an object of this invention to provide an improved apparatus and method for production of structural panel, overcoming some of the problems and shortcomings of the prior art.

Another object of this invention is to provide an improved apparatus and method for producing structural panel having excellent load-bearing properties.

Another object of this invention is to provide an improved apparatus and method for inexpensive production of structural panel.

Another object of this invention is to provide an apparatus and method for production of structural panel from grasses having woody rinds, such as sugarcane and sorghum.

Still another object of this invention is to provide improved low-cost building forms.

These and other important objects will be apparent from the descriptions of this invention which follow.

SUMMARY OF THE INVENTION

Before turning to a description of the method and apparatus of this invention, a description of the structural panel which this invention produces will be helpful.

This invention is an improved apparatus and method for manufacture of structural panel using the rinds of grasses selected from the group consisting of sugarcane and sweet sorghum, i.e., those grasses having woody rinds surrounding a pithy center. While some panels and boards have been disclosed as made with such woody rinds, the panels produced using the apparatus and method of this invention have significantly improved structural characteristics, while being light in weight and fairly easy to produce.

The structural panel made using this invention is formed of a pile of rind fiber-bundle strands which are randomly oriented in substantially parallel planes. The strands are substantially straight and of sufficient length such that most have a stalk node thereon. Each strand has a multiplicity of contact points therealong with other strands of the pile, and a binder which coats the strands interconnects them at such contact points to form a substantially rigid structure. The coated interconnected strands define voids within the pile.

Strand length and substantial straightness are matters of considerable importance. The strands are made of rind fiber bundles, a term used to describe narrow strips of dried woody sugarcane or sorghum rind which, e.g., are split away from half-billet rinds in sugarcane or sweet sorghum processing using the so-called Tilby separation system. Very short, very thin, and/or very curly strands are not usable in such structural panel because they would not impart the desired structural strength.

That is, each strand is preferably at least 15 cm long, while a length of 20–30 cm is very highly preferred as offering the best panel qualities. Such fiber-bundle strands, which have a thickness equal to the thickness of the sugarcane or sorghum rind, are preferably at least about 0.10 cm wide, while widths of about 0.15–0.40 cm are very highly preferred. Dimensions of this general order will assure that the fiber-bundle strands are substantially straight as required.

The binder in the structural panel produced using this invention is preferably a cured thermosetting formaldehyde-based condensation polymer, most preferably a water-resistant amino-formaldehyde polymer. In preferred panels, about 5–20% of the weight of the panel will be binder, an amount well below that used in other fibrous panels. The amount of binder is such that it need not be seen in the finished panel.

The structural panel produced using the apparatus and method of this invention is very light in weight, preferably having a density as low as about 0.15–0.25 g/cc. Yet such panel has superior structural qualities.

In such structural panel the voids mentioned above are sufficient to allow air flow through the pile. This is so even though the panel is quite thick when compared to many other panels and boards. The ability to permit significant air flow through the panel is a quality of importance to the apparatus and method of this invention, as will be pointed out shortly.

Turning now to a description of the method and apparatus of the invention, the method involves: providing a loose collection of substantially straight rind fiber-bundle strands of length such that most have a stalk node thereon, as described above; coating the strands with an uncured binder, such as those noted above; depositing the coated strands on a surface in a loose pile of first thickness with the strands randomly oriented in substantially parallel planes; pressing such loose pile to a substantially lesser final thickness with the strands still in substantially parallel planes; and curing the binder to interconnect each strand with other strands at a multiplicity of contact points along its length, the interconnected strands forming voids within the pile.

In highly preferred embodiments, the curing step includes blowing air through the pile to quickly cure the binder. The air moving through the pile is preferably at temperatures substantially elevated above ambient. For example, a temperature of about 400 degrees Fahrenheit may be used, depending on various factors including the binder chosen.

In preferred embodiments, the surface on which the strands are deposited is a moving conveyor. The pressing step involves advancing the pile with and between an opposed pair of converging perforated belts, one of which is the moving conveyor, the belt pair having a downstream end at which the belts are spaced apart by the final thickness.

The step of moving drying air through the pile is done by blowing air through the perforated belts and the pile held therebetween. This is preferably done by first blowing moist air through the pile and then blowing drier air through the pile. Such order of treatment avoids early formation of a skin which might impede drying and/or otherwise harm product quality. Preferably, a single air stream is directed to pass repeatedly through the pile, the stream moving generally in a direction counter to the direction of movement of the conveyor. Such air stream picks up moisture during such counter movement, to achieve the desired drying characteristics.

The apparatus of this invention includes: means for coating the strands with an uncured binder; a perforated belt conveyor extending away from the coating means, the conveyor having opposite receiving and discharge ends; means between the coating means and the receiving end to deposit the coated strands onto the receiving end in a substantially compressible loose pile with the strands oriented in substantially parallel planes; a perforated belt press extending along a portion of, spaced from, and movable with the conveyor, the press having an upstream end downstream of the receiving end of the conveyor and converging with the conveyor in a downstream direction to press the pile to a final thickness; and means to move air through the press located entirely downstream of the converging portion of the press, the conveyor and the pile therebetween to dry the binder and thereby interconnect each strand with other strands at a multiplicity of contact points along its length.

The air-moving means preferably includes dryer conduit means configured for repeated passage of a single air stream through the pile. The conduit means is preferably configured such that movement of the air stream is in a direction counter to the direction of conveyor movement.

Such conduit means most preferably includes a series of transverse portions oriented for air movement through the conveyor, the press and the pile in directions transverse to the direction of conveyor movement, and turnaround portions which join the transverse portions to provide a single air passage. Blowers and heaters are preferably connected to the turnaround portions to keep the air hot and moving.

BRIEF DESCRIPTION OF THE DRAWINGS

FIG. 3 is a schematic side elevation of a line in accordance with this invention for manufacturing structural panel from the rind of sugarcane and the like.

DETAILED DESCRIPTIONS OF THE PREFERRED EMBODIMENTS

Figure 1:
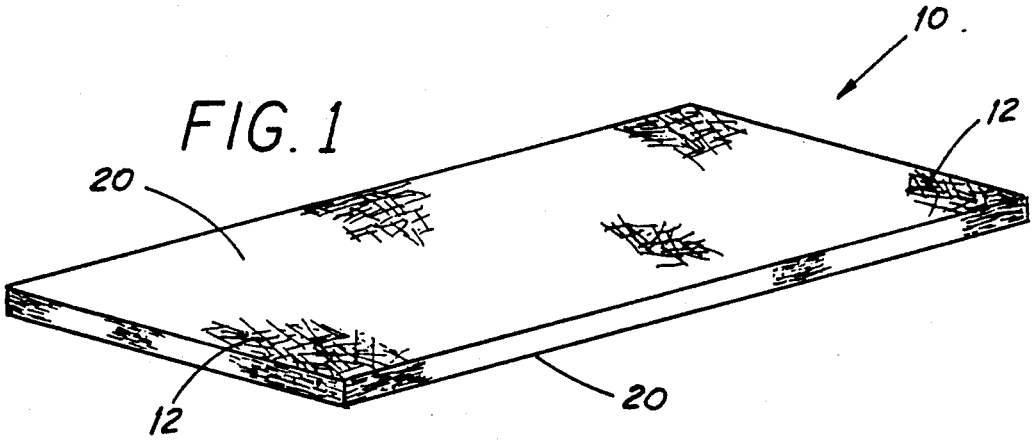
FIG. 1 is a perspective view of a structural panel made in accordance with this invention.
Figure 2:
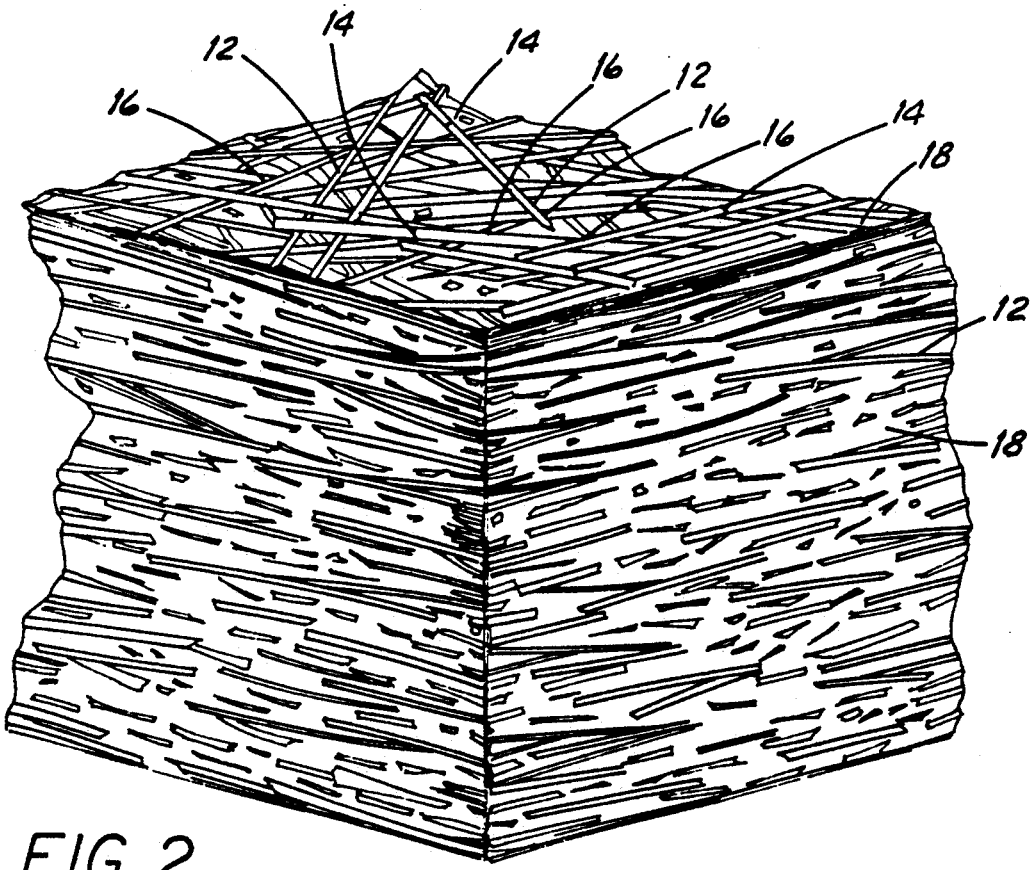
FIG. 2 is an enlarged (actual size) fragmentary perspective of the panel of FIG. 1.

FIGS. 1 and 2 show a structural panel 10 made using the apparatus and method of this invention. Panel 10 may be about 244 cm long, 122 cm wide, and about 7.6 cm thick (4 feet by 8 feet by 3 inches), or any other size useful in particular constructions. At such dimensions, panel 10 offers excellent structural and load-bearing qualities when compared to many panels of the prior art.

FIG. 2 serves to better illustrate some of the details of panel 10. Panel 10 is made from a pile of rind fiber-bundle strands 12 which are taken from the rinds of woody grass selected from the group consisting of sugarcane and sweet sorghum. Strands 12 of the pile are randomly oriented in substantially parallel planes.

While reference throughout this application is made primarily to sugarcane, it is to be understood that such references are in no sense limiting. Fiber-bundle strands of any woody grass as described may be used.

Strands 12 are substantially straight and are long enough that most have a stalk node 14 somewhere along their lengths. Strands 12 are made from the woody rinds of billets of sugarcane or sweet sorghum stalk. Such billets, while cut without reference to the location of stalk nodes, are cut of sufficient length such that, given the range of natural spacings between such stalk nodes, most billets and hence most strands have a stalk node somewhere along their lengths.

To be even more specific, it is preferred that rind fiber-bundle strands 12 be at least about 15 cm long, and most preferably about 20–30 cm long.

The straightness of fiber-bundle strands 12 requires that they not be mere shreds or shavings, but instead substantially rigid pieces of woody rind. Preferred dimensions of strands 12 having such straightness include a thickness equal to the thickness of the rinds from which they are slit and a width of at least about 0.10 cm. Highly preferred widths are about 0.15–0.40 cm, such widths allowing maintenance of good strand straightness even for strands within the preferred range of 20–30 cm in length.

As already noted, strands 12 which constitute panel 10 are randomly oriented in substantially parallel planes. Each strand 12 has a large number of contact points 16 along its length, such contacting strands being interconnected at such points by a binder.

The binder of structural panel 10 is preferably a cured thermosetting formaldehyde-based condensation polymer which coats each strand 12 and interconnects it to other strands of the pile at the very great number of random contact points 16 throughout the pile. Examples of suitable condensation polymers are phenol-formadehyde and melamine-formaldehyde. The most highly preferred polymers are water-resistant amino-formaldehyde polymers, such as melamine-formaldehyde. A particularly preferred polymer composition of the latter type has about 60% melamine and 40% formaldehyde.

Structural panel 10 preferably includes about 5–20% binder by weight of the panel. Thus, structural panel 10 obtains its strength not from the amount of binder used, but from strands 12 and the interconnection of such strands at contact points 16.

Given all these factors, structural panel 10 as significant voids 18 throughout its thickness 10, as can easily be seen in FIGS. 1 and 2. This openness is sufficient to allow air to be blown through the pile, a processing advantage. And, when both of the sides 0 of panel 10 have covering layers thereon, as hereafter described, a dead space is created therebetween which provides excellent insulating qualities.

Voids 18 also allow structural panel 10 to be light in weight. Panel 10 panel preferably has an average density of only about 0.15–0.25 g/cc.

Figure 3:
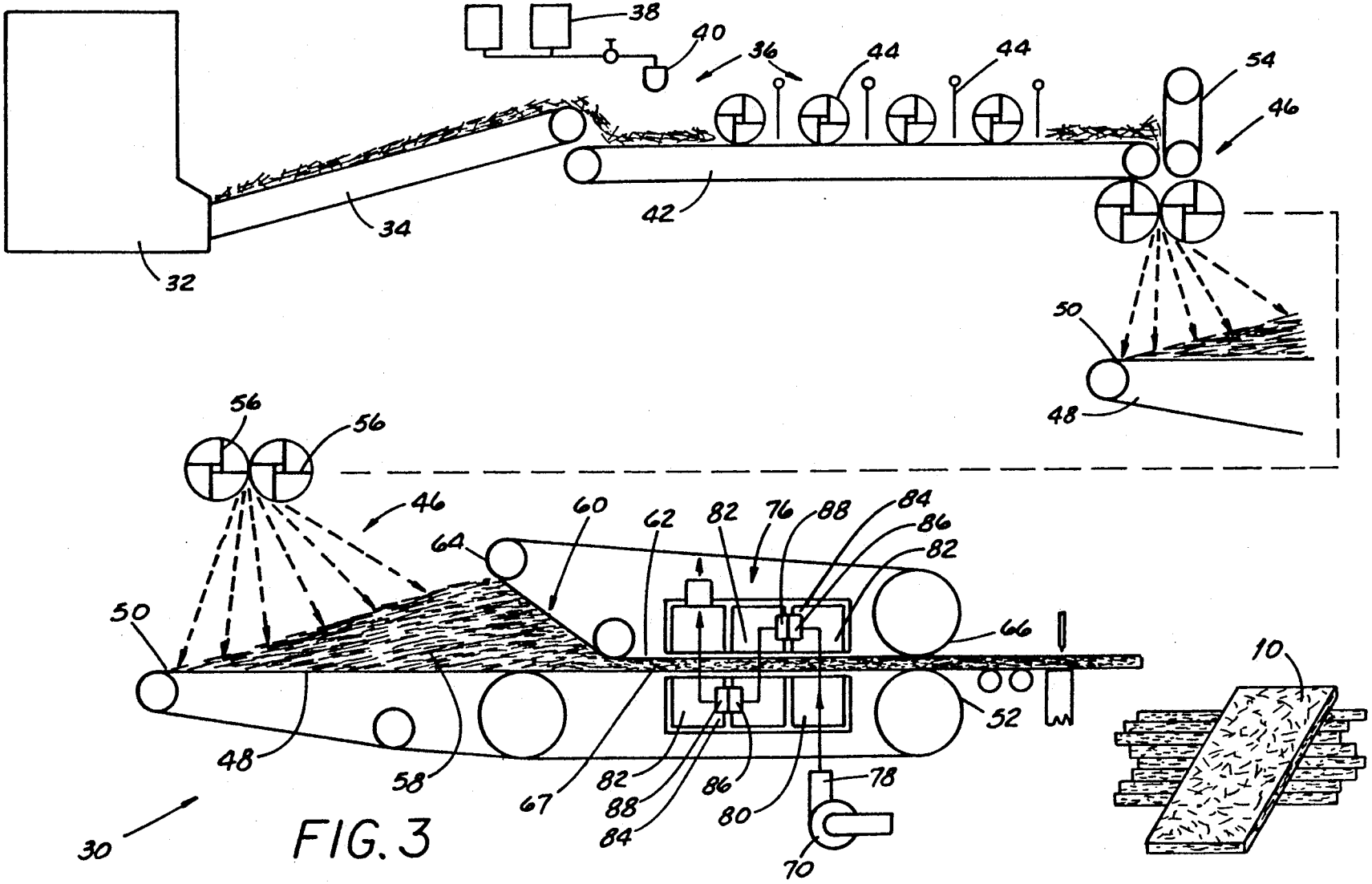

Turning now to information more directly related to the method and apparatus of this invention, FIG. 3 shows a production line 30 for manufacture of panel 10.

Line 30 has a supply 32 of strands of the type described above and a conveyor 34 for moving such strands to a coating station 36. Coating station 36 includes a supply 38 of uncured binder, an elongated weir 40 above a conveyor 42 for dripping binder onto the passing strands, and an array of spreading implements 44 for stirring the mass of strands as it moves along conveyor 42 so that the uncured binder coats essentially every surface of each strand.

Conveyor 42 moves the strand mass to a depositing station 46 located directly above a continuously moving perforated belt conveyor 48 which extends away from the coating means. More specifically, depositing station 46 is above a receiving end 50 of conveyor 48, and conveyor 48 extends downstream to an opposite discharge end 52.

The deposit of strands onto receiving end 50 of conveyer 48 preferably involves what might be described as a sort of throwing of the strands. A particularly preferred device for this purpose is described and claimed in my co-pending, concurrently-filed patent application Ser. No. 07/637,342 entitled "Apparatus and Method for Piling Strands in Random Orientation." Depositing station 46 includes a drop conveyor 54 which cooperates with the downstream end of conveyor 42 to drop the coated strands between an array of flicker arms 56. Flicker arms 56 flick the strands downwardly in a spread pattern to fall on perforated belt conveyor 48 or, in most cases, =a pile 58 of other strands which accumulates on moving perforated belt conveyor 48.

Strand pile 58 on receiving end 50 of conveyor 48 is substantially compressible and relatively loose. Is strands are oriented, on average, in planes which are substantially parallel to each other and at a slight tilt with respect to the plane of conveyor 48. Such tilt occurs because pile 58 is continuously moving away from depositing station 46. When pile 58 is compressed, as occurs at compression station 60, the angle of such tilt is substantially lessened, such that the strands, on average, are in parallel planes which are much closer to parallel to the plane of conveyor 48.

Compression station 60 is formed in a zone of convergence between two perforated moving belts—the perforated belt of conveyor 48 and a perforated belt press 62. Perforated belt press 62 extends along a portion of conveyor 48, is above and spaced from conveyor 48, and is movable with conveyor 48. Perforated belt press 62 has an upstream end 64 which is downstream of receiving end 50 of conveyor 48, and a downstream nd 66 which is aligned with discharge end 52 of conveyor 48.

Perforated belt press 62 converges with conveyor 48 in a downstream direction to press compressible pile 58 into a panel pile 67 having the thickness of panel 10 This is preferably on the order of one-seventh the thickness of the uncompressed pile. However, the extent of compression can be adjusted to change the density and structural characteristics of panel 10.

Figure 4:
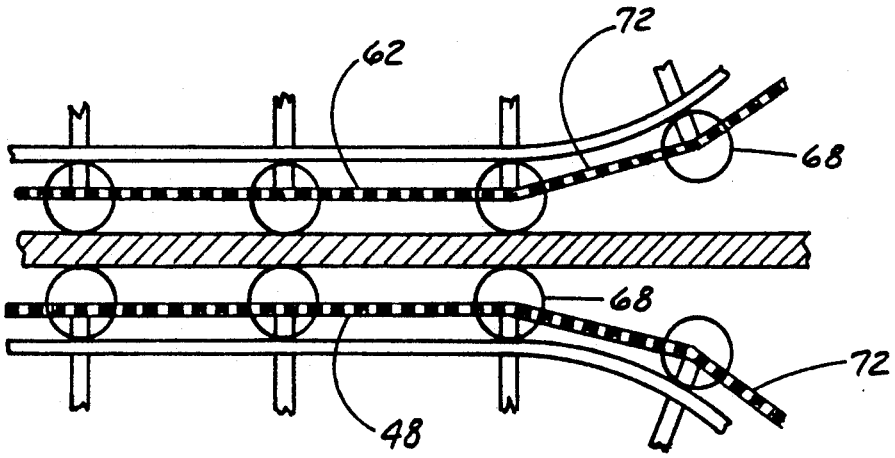
FIG. 4 is an enlarged fragmentary view showing some details of the perforated conveyor and perforated belt press.

FIG. 4 shows a preferred construction of portions of perforated conveyor 48 and perforated belt press 62, near their respective downstream ends. Such perforated belts are attached along their opposite edges to a series of rollers 68 which ride on opposed roller tracks as shown. This assures that the perforated belts, in their zone of convergence and along their parallel portions, properly compress and hold the strand pile.

FIG. 4 also serves to illustrate perforations 72 in belt conveyor 48 and belt press 62. Perforations 72 and the open structure of panel pile 67 allows the pile to be dried (that is, the binder to be cured) by blowing air through belt press 62, belt conveyor 48, and panel pile 67 therebetween as pile 67 moves down the line.

This is accomplished by moving belt conveyor 48 and belt press 62 through a drying station 76, such moving elements entering and exiting drying station 76 with minimal clearances. Drying station 76 in the preferred form illustrated, includes a blower 70 and an air heater 78 at the beginning of a dryer conduit 80. Conduit 80 is configured for passage of a single air stream through moving belts 48 and 62 and panel pile 67 three times, such movements therethrough being in series fashion.

To accomplish this, conduit 80 includes three transverse portions 82 oriented for air movement through the conveyor, press and pile in directions transverse to the direction of conveyor movement, and two turnaround portions 84 joining transverse portions 82 to provide a single air passage. Supplemental blowers and heaters 86 and 88 are located in turnaround portions 84 to keep: the air moving and hot.

The first passage of drying air through the conveyor, press and pile is at a downstream portion of the line with successive through passages in each case being more upstream, such that movement of the air stream is in a direction generally counter to the direction of conveyor movement.

Many variations are possible in apparatus and method in carrying out and utilizing this invention. Acceptable choices would be apparent to those skilled in the art.

The product of this invention has a wide variety of applications. Structural panel 10 can be used for walls and ceilings of buildings without the necessity for a full complement of wall studs, ceiling joists and the like, as is common. Buildings having substantial structural stability can be built in this manner. Properly constructed, such buildings can have the ability to withstand hurricane-force winds.

When used as a ceiling, or for other purposes, structural panel 10 can simply have one or both of its sides spray-painted. Ceiling panels having this look, in addition to having a good appearance, have excellent acoustical qualities. Coating the opposite sides of panel 10, or even just one side, with a plaster-like material (for example, common plaster) gives an excellent appearance. Such coatings adhere well by virtue of voids 18 with which a plaster-like material bonds extremely well. Also, such coatings and other sorts of coating layers significantly enhance the good structural strength of panel 10.

Two panels of the type described can be securely joined along abutting edges or between an edge and a facing surface by means of mortar-like material (for example, common mortar). Thus, such panels are very useful in building construction.

While the principles of this invention have been described in connection with specific embodiments, it should be understood clearly that these descriptions are made only by way of example and are not intended to limit the scope of the invention.

I claim:

1. Apparatus for manufacture of structural panel from substantially stiff substantially straight elongated fiber-bundle strands of the rinds of grass selected from the group consisting of surgarcane and sweet sorghum, the strands of length such that most have a stalk node thereon, comprising:

means for coating the strands with an uncured binder;

a perforated belt conveyor extending away from the coating means, the conveyor having opposite receiving and discharge ends;

means between the coating means and the receiving end to deposit the coated strands onto the receiving end in a substantially compressible loose pile with the strands oriented in random directions in substantially parallel planes;

a perforated belt press extending along a portion of, spaced from, and movable with the conveyor, the press having an upstream end downstream of the receiving end of the conveyor and converging with the conveyor in a downstream direction to press the pile to a final thickness with the strands still randomly oriented in substantially parallel planes and with substantial voids to allow air flow therethrough; and curing means entirely downstream of the converging portions of the perforated belt press and conveyor which move air substantially freely through the press and conveyor and the pile therebetween at said final pile thickness thereby to interconnect each strand with other strands at a multiplicity of contact points along its length;

whereby structural panel with substantial open voids throughout and density no greater than about 0.25 g/cc may be produced.

2. The apparatus of claim 1 wherein the means for moving air comprises dryer conduit means configured for repeated passage of a single air stream through the pile.

3. The apparatus of claim 2 wherein the conveyor is movable in a first direction and the conduit means is configured such that movement of the air stream is in a direction counter to the first direction.

4. The apparatus of claim 3 wherein the conduit means comprises:

a series of adjacent transverse portions oriented for air movement through the conveyor and press and the pile therebetween in directions transverse to the direction of conveyor movement; and turnaround portions joining the adjacent transverse portions.

5. The apparatus of claim 4 further comprising blowers and heaters connected to the turnaround portions.

6. The apparatus of claim 1 wherein the depositing means comprises means to throw the coated strands to land on the receiving end of the conveyor.

7. The apparatus of claim 1 wherein the final thickness is at least about 5 cm.

* * * * *